US005736495A

United States Patent [19]

Bolkan et al.

[11] Patent Number: 5,736,495

[45] Date of Patent: Apr. 7, 1998

[54] AQUEOUS METAL CLEANER HAVING AN ANTICORROSION SYSTEM

[75] Inventors: Steven A. Bolkan, Hopewell; Steve Dunn, Hillsborough, both of N.J.

[73] Assignee: Church & Dwight Co., Inc., Princeton, N.J.

[21] Appl. No.: 543,830

[22] Filed: Oct. 16, 1995

Related U.S. Application Data

[63] Continuation-in-part of Ser. No. 609,895, Mar. 4, 1996, Pat. No. 5,650,385, which is a continuation of Ser. No. 311,254, Sep. 23, 1994, abandoned.

[51] Int. Cl.[6] ..... C11D 7/04; C11D 7/32

[52] U.S. Cl. ..... 510/202; 510/245

[58] Field of Search ..... 510/245, 202

[56] References Cited

U.S. PATENT DOCUMENTS

| | | |
|---|---|---|
| 3,419,502 | 12/1968 | Newman . |
| 3,637,511 | 1/1972 | Yang . |
| 3,959,166 | 5/1976 | Oberhofer et al. . |
| 3,962,109 | 6/1976 | Oberhofer et al. . |
| 4,098,720 | 7/1978 | Hwa . |
| 4,382,008 | 5/1983 | Boreland et al. . |
| 4,389,371 | 6/1983 | Wilson et al. . |
| 4,426,309 | 1/1984 | Abel et al. . |
| 4,450,102 | 5/1984 | Lindstrom et al. . |
| 4,540,442 | 9/1985 | Smith et al. . |
| 4,575,569 | 3/1986 | Edwards . |
| 4,620,936 | 11/1986 | Kielman et al. . |
| 4,759,864 | 7/1988 | Van Neste et al. . |
| 4,931,205 | 6/1990 | Edwards et al. . |
| 5,093,031 | 3/1992 | Login et al. . |
| 5,230,824 | 7/1993 | Carlson, Jr. et al. . |

*Primary Examiner*—Margaret Medley
*Attorney, Agent, or Firm*—Irving Fishman

[57] ABSTRACT

A composition and method for cleaning metal and for inhibiting corrosion of metal. The composition is composed of an alkaline metal salt, a surfactant, and a corrosion inhibitor with a pH in the range from about 7.5 to less than 10, and is preferably silicate free. The corrosion inhibitor is provided in the form of a combination of a triazole compound and an alkali metal borate. The composition can be employed to clean metal surfaces as an aqueous concentrate or aqueous solution.

49 Claims, No Drawings

AQUEOUS METAL CLEANER HAVING AN ANTICORROSION SYSTEM

BACKGROUND OF THE INVENTION

The present application is a continuation-in-part of U.S. application Ser. No. 08/609,895, filed Mar. 4, 1996, now U.S. Pat. No. 5,650,385 which is a continuation of U.S. application Ser. No. 08/311,254, filed Sep. 23, 1994 and now abandoned.

The present invention relates generally to aqueous metal cleaning compositions. In particular, this invention is directed to aqueous metal cleaning compositions useful in so-called parts washers which are particularly adapted to be used for industrial cleaning, as well as for domestic use.

Parts washers of various kinds are known to those skilled in the art as having great utility for mechanics and others working in a variety of occupations, particularly those working in industrial plants, maintenance and repair services, and the like. The parts washers referred to herein include soak tanks, so-called hot tanks, immersion type parts cleaners with or without air agitation, spray washers (continuous or batch) and ultrasonic baths. Generally, parts washers are used to remove all types of contaminants adhered to the metal surface including greases, cutting fluids, drawing fluids, machine oils, antirust oils such as cosmoline, carbonaceous soils, sebaceous soils, particulate matter, waxes, paraffins, used motor oil, fuels, etc.

Until recently, metal surfaces were cleaned of most oily and greasy contamination by use of solvents. Existing solvents, with or without special additives, are adequate to achieve good cleaning of most dirty, greasy, metal parts. A great number of solvents have been employed to produce metallic surfaces free from contamination. These wash solvents generally include various halogenated hydrocarbons and non-halogenated hydrocarbons, of significant quantity industry wide for cleaning and degreasing of the metal surfaces, and the degree of success with each of these wash solvents is generally dependent upon the degree of cleanliness required of the resultant surface.

Recently, however, the various hydrocarbon and halogenated hydrocarbon metal cleaning solvents previously employed have come under scrutiny in view of the materials employed, and in particular, the environmental impact from the usage of the various materials. This is particularly so in the case of parts cleaning which is done in closed environments such as garages and the like or for even home usage in view of the close human contact. Even the addition of devices to parts washers which can reduce spillage, fire and excessive volatilization of the cleaning solvent are not sufficient to alleviate present environmental concerns.

Although the halogenated hydrocarbon solvents such as chlorofluorocarbons (CFCs) and trichloromethane, methylene chloride and trichloroethane (methyl chloroform) are widely used in industry for metal cleaning, their safety, environmental and cost factors coupled with waste disposal problems are negative aspects in their usage. A world-wide and U.S. ban on most halogenated hydrocarbon solvents is soon in the offing by virtue of the Montreal Protocol, Clean Air Act and Executive and Departmental directives.

The non-halogenated hydrocarbon solvents such as toluene and Stoddard solvent and like organic compounds such as ketones and alcohols on the other hand are generally flammable, have high volatility and dubious ability to be recycled for continuous use. These, plus unfavorable safety, environmental and cost factors, put this group of solvents in a category which is unattractive for practical consideration.

Most useful organic solvents are classified as volatile organic compounds (VOCs) which pollute the atmosphere, promote formation of toxic ozone at ground level, and add to the inventory of greenhouse gases.

In order to eliminate the various negative aspects of the known chemical washing and degreasing systems, it has, therefore, been suggested that an aqueous detergent system be used so as to overcome some of the inherent negative environmental and health aspects of prior art solvent cleaning systems. Unfortunately, aqueous cleaning systems are not without their own problems as related to use thereof in metal cleaning systems including use in parts washers as described above. For example, certain of the aqueous cleaners are exceedingly alkaline having pHs of 13 and above such as sodium hydroxide, or include organic solvents such as alkanolamine, ethers, alcohols, glycols, ketones and the like. Besides being highly corrosive, the exceedingly high alkaline aqueous solutions are highly toxic and can be dangerous to handle requiring extreme safety measures to avoid contact with skin. Organic solvent-containing aqueous cleaners present the problems regarding toxicity, volatility or the environment as expressed previously. On the other hand, it is most difficult to obtain an aqueous detersive solution at moderate pH which is effective in removing the greases and oils which contaminate metal including metal engine parts and which would not be corrosive to the metal substrate.

One particular disadvantage of using aqueous systems to clean metal surfaces is the potential to corrode or discolor the surfaces. While aqueous cleaning solutions having a high pH such as formed from sodium hydroxide are often more corrosive than aqueous solutions having a relatively low pH, such as formed by mildly alkaline detergents, corrosion and discoloration still are problematic with the more mild solutions.

Various corrosion inhibitors are known and have been used to prevent corrosion of surfaces which come into contact with aqueous alkaline solutions. This is because no one inhibitor, or combination of inhibitors, yet has provided protection for all metals and metal alloys. Examples of corrosion inhibitors include inorganic compounds such as alkali metal phosphates, borates, molybdates, arsenates, arsenites, nitrates, silicates, nitrites, and chromates, as well as various organic compounds such as mercaptobenzothiazole, benzotriazole, piperazine, ethylene diamine tetracetic acid and the reaction product of phosphoric acid or boric acid and an alkanolamine. Probably, the most effective and least costly of the known corrosive inhibitors are the silicates, such as alkali metal silicates. Unfortunately, alkali metal silicates begin to precipitate from aqueous solution at pHs below 11, thus, greatly reducing the effectiveness of these materials to prevent corrosion of the contacted surfaces when used in aqueous cleaning solutions having a pH below 11.

Certain corrosion inhibitors have been employed as anticorrosion agents in antifreeze formulations such as the liquid alcohol antifreeze formulation disclosed in U.S. Pat. No. 4,759,864, issued to Van Neste et al. Van Neste et al. assert effective anticorrosion activity in automobile radiators by a combination of a $C_6$–$C_{12}$ aliphatic monobasic or dibasic acid and an alkali metal borate. However, a disadvantage of Van Neste et al. is that they do not disclose any cleaning ability in their composition, and their antifreeze compositions contain organic solvents.

U.S. Pat. No. 3,962,109, issued to Oberhofer et al., discloses a cleaner-inhibitor for automotive or diesel coolant systems. Oberhofer et al. employ azole compounds, such as benzothiazole, in combination with mercaptobenzothiazole, to prevent copper deposition back onto ferrous metal surfaces; a boron-nitrate combination and alkali metal silicates as metal anticorrosion agents. However, a disadvantage of the compositions of Oberhofer et al. is the relatively high concentrations of borax in solution (1–10%). Boron compounds, if ingested in large quantities, can lead to nervous system damage in animals and also can be toxic to many plant species. Moreover, the composition disclosed in Oberhofer et al. contain both nitrites and amines. Amine and nitrite compounds can form dangerous nitroso compounds when used together. Also, Oberhofer et al. employ silicates in their compositions with a pH range of from 7.5 to as high as 12.6. A pH value of less than 11, although more desirable, leads to precipitation of silicate, thus compromising silicate anticorrosion activity. Thus, it would be advantageous to develop a metal cleaner with an anticorrosion system which eliminates amine and nitrite combinations, preferably eliminates silicates to permit cleaning compositions with mild pHs of less than 10, and reduces the amount of borate employed, while still retaining effective borate anticorrosion activity.

Accordingly, to be as effective and be able to replace the halogenated and hydrocarbon solvents now widely used, and to eliminate or reduce certain environmentally hazardous compounds, aqueous metal cleaning compositions will have to be formulated to solve the problems associated therewith including efficacy of detersive action at mild pH levels and the corrosiveness inherent in aqueous based systems, in particular, on metal substrates.

Thus, there still is need for an improved metal cleaning composition with an improved anticorrosion inhibitor.

Accordingly, it is an object of this invention to provide an aqueous metal cleaning composition which is effective to clean grease, oil and other contaminants from a metal surface without being excessively corrosive to the substrate and irritating to human skin.

Another object of the invention is to provide an aqueous metal cleaning composition which can be used effectively in a variety of parts washing equipment so as to efficiently remove grease, oil and other contaminants from metal parts and which is safe to use and not a hazard to the environment in use or upon disposal.

Still another object of the present invention is to provide an aqueous metal cleaning composition which contains an effective corrosion inhibitor.

Still yet another object of the present invention is to provide an aqueous metal cleaning composition of mild pH which has effective detersive action and which can provide effective corrosion protection to the metal substrate being cleaned.

SUMMARY OF THE INVENTION

The above-mentioned objectives and other objects are obtained in accordance with the present invention by providing aqueous alkaline metal cleaning compositions which have a pH of from about 7.5 to less than 10 but a sufficiently high pH to effectively clean dirt, grease, oil and the like from metal parts and which include a combination metal corrosion inhibitor effective in mildly alkaline aqueous solutions. Surprisingly, the combination of a triazole compound and an alkali metal borate in mild aqueous alkaline cleaning compositions of the present invention has been found to be especially effective as a corrosion inhibitor of copper and copper alloys. Unlike cleaning preparations containing halogenated or hydrocarbon solvents, nitrites and amines, or high concentrations of boron compounds, aqueous alkaline cleaning solutions of this invention are environmentally safer to use and have lower amounts of organics which do not readily volatilize and which are safe on disposal thereof.

Preferably, detersive ability of aqueous alkaline cleaning compositions of the present invention are enhanced by addition of a surfactant. Particularly useful surfactants which can be used in cleaning compositions of this invention are ones which are low foaming and do not readily emulsify oil and grease. More importantly such surfactants provide a distinct oil and water phase separation to allow grease and oil to be skimmed from the wash bath for disposal. Consequently, cleaning and anticorrosion ability of aqueous cleaners of the present invention can be maintained for prolonged reuse.

DETAILED DESCRIPTION OF THE INVENTION

Aqueous cleaning-anticorrosion compositions of the present invention comprise an alkaline metal salt, a surfactant, and an anticorrosion agent having a triazole compound in combination with an alkali metal borate.

Metal cleaning compositions of the present invention are useful for removing any type of contaminant from a metal surface including greases, cutting fluids, drawing fluids, machine oils, antirust oils such as cosmoline, carbonaceous soils, sebaceous soils, particulate matter, waxes, paraffins, used motor oil, fuels, etc. Any metal surface can be cleaned including iron-based metals such as iron, iron alloys, e.g., steel, tin, aluminum, copper, tungsten, titanium, molybdenum, etc., for example. The structure of the metal surface to be cleaned can vary widely and is unlimited. Thus, the metal surface can be as a metal part of complex configuration, sheeting, coils, rolls, bars, rods, plates, disks, etc. Such metal components can be derived from any source including for home use, for industrial use such as from the aerospace industry, automotive industry, electronics industry, etc., wherein the metal surfaces have to be cleaned.

Treatment of copper or copper alloy surfaces with the compositions of this invention has been found particularly effective.

Aqueous alkaline metal cleaning solutions of this invention comprising the cleaning composition in water have a pH of from about 7.5 to less than 10.0 to render these solutions substantially less harmful to use and handle than highly alkaline aqueous cleaners such as those formed from sodium hydroxide or aqueous alkanolamine solutions. The solutions preferably have a pH of about 8.0 to less than 10.0 to effectively clean typical metal substrates. Most preferably, the aqueous alkaline cleaning solutions have a pH from about 9.0 to 9.8 which is effective to remove the dirt, grease, oil and other contaminants from the metal surface without causing tarnishing or discoloration of the metal substrate and yet allow the solutions to be used, handled and disposed of without burning or irritating human skin. It is preferable that the compositions and resultant aqueous alkaline cleaning solutions formed therefrom be free of nitrites and organic solvents including hydrocarbon, halohydrocarbon and oxygenated hydrocarbon solvents.

Alkaline providing agents of the aqueous metal cleaning compositions of the present invention can be provided by one or more alkaline metal salts. Suitable alkaline metal salts or mixtures thereof useful in the present invention are those capable of providing the desired mild pH. Most suitable are salts of potassium and sodium. Especially preferred are potassium and sodium carbonates and bicarbonates which are economical, safe and environmentally friendly. Carbonate salts include potassium carbonate, potassium carbonate dihydrate, potassium carbonate trihydrate, sodium carbonate, sodium carbonate decahydrate, sodium carbonate heptahydrate, sodium carbonate monohydrate, sodium sesquicarbonate and double salts and mixtures thereof. Bicarbonate salts include potassium bicarbonate and sodium bicarbonate and mixtures thereof. Mixtures of carbonate and bicarbonate salts also are especially useful.

Other suitable alkaline metal salts which can be used include alkaline metal ortho or complex phosphates. Examples of alkaline metal orthophosphates include trisodium or tripotassium orthophosphate. Complex phosphates are especially effective because of their ability to chelate water hardness and heavy metal ions. The complex phosphates include, for example, sodium or potassium pyrophosphate, tripolyphosphate and hexametaphosphates. It is preferred to limit the amount of phosphates (phosphorus) to less than 3 wt. % relative to the total weight of the dry composition inasmuch as phosphates are ecologically undesirable being a major cause of eutrophication of surface waters. Additional suitable alkaline salts useful in the metal cleaning compositions of this invention include the alkaline metal acetates, citrates, tartrates, succinates, phosphonates, edates, dilute solutions of sodium or potassium hydroxide, etc. It is preferred to maintain the compositions of this invention silicate-free due to the resultant high pH and difficulty in formulating a composition which will remain soluble in aqueous solution at pH's of less than 10 when silicates are present.

If alkali metal silicates are used, those having the formula $M_2O.(SiO_2)_n$ where M represents an alkali metal and n is a number of from about 1.6 to about 3.6, and most preferably from about 2.9 to about 3.3 are employed. Silicates preferably are used in the commercially available form known as liquid sodium silicate is commercially available from E. I duPont de Nemours & Co., Wilmington, Del. under the trade designation "duPont's Grade F."

Corrosion inhibitor added to metal cleaning compositions of this invention include a triazole compound in combination with an alkali metal borate. Triazoles which can be employed in the compositions of this invention are any water-soluble 1,2,3-triazole such as 1,2,3-triazole itself having the formula

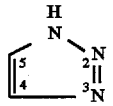

or an N-alkyl substituted 1,2,3-triazole, or a substituted water soluble 1,2,3-triazole where the substitution takes place in the 4- and/or 5-position of the triazole ring. Preferred 1,2,3-triazole is benzotriazole (sometimes known as 1,2,3-benzotriazole) having the structural formula:

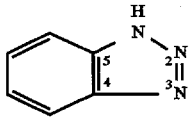

Other suitable water soluble derivatives include, for example, 4-phenyl-1,2,3-triazole,; 1,2-naphthotriazole; 4-nitrobenzotriazole; 1,2,3-tolytriazole; 4-methyl-1,2,3-triazole; 4-ethyl-1,2,3-triazole; 5-methyl-1,2,3-triazole; 5-ethyl-1,2,3-triazole; 5-propyl-1,2,3-triazole; 5-butyl-1,2,3-triazole; and the like.

Alkali metal borate components of the present invention can be any borax, alkali metal metaborate or alkali metal tetraborate compound; or mixtures thereof. Hydrated alkali metal tetraborate compounds are particularly preferred, with sodium tetraborate decahydrate and pentahydrate being the most preferred for use in the instant invention. The combination of a triazole and an alkali metal borate has anticorrosion activity on all metals, but is especially effective in inhibiting corrosion of copper-containing metals.

Additionally, other anticorrosion agents which can be added to the compositions of the present invention include, but are not limited to, magnesium ions. Any suitable source of magnesium ions can be added to the alkaline metal cleaning compositions to practice this invention. A preferred source of magnesium ions is water soluble magnesium oxide. Other suitable sources of magnesium ions include, but are not limited to, water soluble salts of chlorides, nitrates and sulfates of magnesium.

In order to assist in maintaining the dispersibility of magnesium corrosion inhibitors in aqueous solution, in particular, under the mildly alkaline pH conditions most useful in this invention and in the presence of agents which would otherwise cause precipitation of magnesium ions, e.g., carbonates, phosphates, etc., it has been found advantageous to include a carboxylated polymer to the solution. The useful carboxylated polymers may be generically categorized as water-soluble carboxylic acid polymers such as polyacrylic and polymethacrylic acids or a vinyl addition polymer. Of the vinyl addition polymers contemplated, maleic anhydride copolymers as with vinyl acetate, styrene, ethylene, isobutylene, acrylic acid and vinyl ethers are preferred.

All of the above-described polymers are water-soluble or at least colloidally dispersable in water. The molecular weight of these polymers may vary over a broad range although it is preferred to use polymers having average molecular weights ranging between 1,000 up to 1,000,000. In a preferred embodiment of the invention, these polymers have a molecular weight of 100,000 or less and, most preferably, between 1,000 and 10,000.

The water-soluble polymers of the type described above are often in the form of copolymers which are contemplated as being useful in the practice of this invention provided they contain at least 10% by weight of

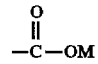

groups where M is hydrogen, alkali metal, ammonium or other water-solubilizing radicals. The polymers or copolymers can be prepared by either addition or hydrolytic techniques. Thus, maleic anhydride copolymers are prepared by the addition polymerization of maleic anhydride and another comonomer such as styrene. The low molecular weight acrylic acid polymers can be prepared by addition polymerization of acrylic acid or its salts either with itself or other vinyl comonomers. Alternatively, such polymers can be prepared by the alkaline hydrolysis of low molecular weight acrylonitrile homopolymers or copolymers. For such a preparative technique see Newman U.S. Pat. No. 3,419,502 which is hereby incorporated herein in its entirety by reference.

As previously stated, maleic anhydride polymers are preferred. Especially useful maleic anhydride polymers are selected from the group consisting of homopolymers of maleic anhydride, and copolymers of maleic anhydride with vinyl acetate, styrene, ethylene, isobutylene, acrylic acid and vinyl ethers. These polymers can be easily prepared according to standard methods of polymerization.

The carboxylated polymers aid in maintaining the magnesium in solution, thereby preventing the precipitation of magnesium from solution and consequent degradation of corrosion protection. Further, carboxylated polymers prevent scaling due to precipitation of water hardness salts formed during reaction with the alkaline salts of the cleaning compositions of this invention.

To improve cleaning efficacy of the cleaning compositions of the present invention, it is preferred to add one or more surfactants. Nonionic surfactants are preferred as such surfactants are best able to remove the dirt, grease and oil from the metal substrates.

Among the most useful surfactants in view of the ability thereof to remove grease and oil are the nonionic alkoxylated thiol surfactants. Nonionic alkoxylated (ethoxylated) thiol surfactants of the present invention are known and are described for example in U.S. Pat. Nos. 4,575,569 and 4,931,205, the contents of both of which are herein incorporated by reference. In particular, the ethoxylated thiol is prepared by the addition of ethylene oxide to an alkyl thiol of the formula R-SH wherein R is alkyl in the presence of either an acid or base catalyst. Thiol reactant that is suitable for producing surfactant used in the practice of the present invention comprises, in the broad sense, one or more of the alkane thiols as have heretofore been recognized as suitable for alkoxylation by reaction with alkylene oxides in the presence of basic catalysts. Alkane thiols in the 6 to 30 carbon number range are particularly preferred reactants for the preparation of thiol alkoxylates for use as surface active agents, while those in the 7 to 20 carbon number range are considered more preferred and those in the 8 to 18 carbon number range most preferred.

Broadly, the surfactant can be formed from reaction of the above alkyl thiol and one or more of several alkylene oxides known for use in alkoxylation reactions with thiols and other compounds having active hydrogen atoms. Particularly preferred are vicinal alkylene oxides having from 2 to 4 carbon atoms, including ethylene oxide, 1,2-propylene oxide, and the 1,2- and 2,3-butylene oxides. Mixtures of alkylene oxides are suitable in which case the product will be mixed thiol alkoxylate. Thiol alkoxylates prepared from ethylene or propylene oxides are recognized to have very advantageous surface active properties and for this reason there is a particular preference for a reactant consisting essentially of ethylene oxide which is considered most preferred for use in the invention.

The relative quantity of thiol and alkylene oxide reactants determine the average alkylene oxide number of the alkoxylate product. In the alkoxylated thiol surfactant of this invention an adduct number in the range from about 3 to 20, particularly from about 3 to 15 is preferred. Accordingly, preference can be expressed in the practice of the invention for a molar ratio of alkylene oxide reactant to thiol reactant which is in the range from about 3 to 20, particularly from about 3 to 15. Especially preferred is an ethoxylated dodecyl mercaptan with about 6 ethylene oxide units. Such a surfactant is a commercial product known as ALCODET 260 marketed by Rhone-Poulenc.

Unfortunately, ethoxylated thiol surfactant has an unpleasant odor which is imparted to the aqueous solution in which it is placed. It has been found that addition of a nitrogen-containing surfactant eliminates the odor of the sulfur-containing surfactant and does not adversely effect the efficacy of the ethoxylated thiol surfactant to remove grease, oil and the like from the metal surfaces. Among useful nitrogen-containing nonionic surfactants are the following:

A surfactant having a formula $R^1R^2R^3N\rightarrow 0$ (amine oxide detergent) wherein $R^1$ is an alkyl group containing from about 10 to about 28 carbon atoms, from zero to about two hydroxy groups and from zero to about five ether linkages, there being at least one moiety of $R^1$ which is an alkyl group containing from about 10 to about 18 carbon atoms and zero ether linkages, and each $R^2$ and R3 are selected from the group consisting of alkyl radicals and hydroxyalkyl radicals containing from one to about three carbon atoms.

Specific examples of amine oxide surfactants include: Dimethyldodecylamine oxide, dimethyltetradecylamine oxide; ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis-(2-hydroxyethyl)-3-dodecoxy-1-hydroxypropyl amine oxide, (2-hydroxypropyl) methyltetradecylamine oxide, dimethyloleyamine oxide, dimethyl-(2-hydroxydodecyl)amine oxide, and the corresponding decyl, hexadecyl and octadecyl homologs of the above compounds.

Additional nitrogen-containing surfactants include ethoxylated primary alkyl amines where the alkyl group has 10–20 carbon atoms and the amine is ethoxylated with 2–20 ethylene oxide units. Further surfactants include ethoxylated long chain fatty acid amides where the fatty acid has 8–20 carbon atoms and the amide group is ethoxylated with 1–20 ethylene oxide units. Additionally, nonionic surfactants derived from the condensation of ethylene oxide with the product resulting from the reaction of propylene oxide and ethylene diamine are also useful. For example, compounds containing from about 40% to about 80% of polyoxyethylene by weight and having a molecular weight from about 5,000 to about 11,000 resulting from the reaction of ethylene oxide groups with a hydrophobic base constituted of the reaction product from ethylene diamine and excess propylene oxide wherein the base has a molecular weight on order of 2,500–3,000 are satisfactory.

One of the most useful nitrogen-containing surfactants are those derived from N-alkyl pyrrolidone. This surfactant is one which can be used alone to achieve excellent cleaning or used in combination with the ethoxylated thiol surfactant. Particularly preferred is N-(n-alkyl)-2-pyrrolidone wherein the alkyl group contains 6–15 carbon atoms. These compounds are described in U.S. Pat. No. 5,093,031, assigned to ISP Investments, Inc., Wilmington, Del. and which discloses surface active lactams and is herein incorporated by reference. The above N-alkyl pyrrolidone products having a molecular weight of from about 180 to about 450 are conveniently prepared by several known processes including the reaction between a lactone having the formula

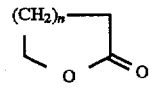

wherein n is an integer from 1 to 3, and an amine having the formula $R'—NH_2$ wherein R' is a linear alkyl group having 6 to 20 carbon atoms. The amine reactant having the formula $R'—NH_2$ includes alkylamines having from 6 to 20 carbon atoms; amines derived from natural products, such as coconut amines or tallow amines distilled cuts or hydrogenated derivatives of such fatty amines. Also, mixtures of amine reactants can be used in the process for preparing the pyrrolidone compounds.

Generally, the $C_6$ to $C_{14}$ alkyl pyrrolidones have been found to display primarily surfactant properties; whereas the $C_{16}$ to $CR_{22}$ alkyl species are primarily complexing agents; although some degree of surfactants and complexing capability exists in all of the present species.

The relative amounts of the ethoxylated thiol surfactant and nitrogen-containing surfactant if used in combination are not overly critical as far as a contrite range is concerned in that the amount of the nitrogen surfactant will vary depending on the surfactant used. The amount of nitrogen-containing surfactant used should be that which can reduce if not eliminate the odor of the ethoxylated thiol surfactant. In general, it is believed that the relative amounts by weight of the ethoxylated thiol surfactant to the nitrogen-containing surfactant should range from about 1.0:0.1 to 1.0:2.0, and preferably from about 1.0:0.2 to 1:1. It is not meant that these ratios are to be considered as strictly limiting the invention and as providing the only relative amounts of the respective surfactants which can be effectively used and accordingly, it is intended that any useful ratio be considered part of the present invention. Any useful ratio is that ratio which is sufficient to remove the dirt, grease, oil and other contaminants from the metal surface and which will yield an aqueous product which has greatly reduced malodor relative to an equivalent composition in which the ethoxylated thiol surfactant is present and the nitrogen-containing surfactant is not.

Other surfactants can be used in the compositions of this invention other than or in addition to the above described surfactants. Especially preferred are surfactants which do not readily emulsify the contaminants removed from the metal surface such that a distinct aqueous and oil phase is formed and contaminants in the oil phase can then be easily skimmed or otherwise easily separated from the wash bath for disposal. Consequently, the cleaning ability of the aqueous cleaner can be maintained for prolonged reuse. It is believed that most of the ethoxylated surfactants do not substantially emulsify the removed contaminants.

Suitable non-ionic surfactants include the polyoxyethylene-polyoxypropylene condensates, which are sold by BASF under the tradename "Pluronic", polyoxyethylene condensates of aliphatic alcohols/ethylene oxide condensates having from 1 to 30 moles of ethylene oxide per mole of coconut alcohol; ethoxylated long chain alcohols sold by Shell Chemical Co. under the tradename "Neodol", polyoxyethylene condensates of sorbitan fatty acids, alkanolamides, such as the monoalkoanolamides, dialkanolamides and the ethoxylated alkanolamides, for example coconut monoethanolamide, lauric isopropanolamide and lauric diethanolamide; and amine oxides for example dodecyldimethylamine oxide. Examples of suitable anionic surfactants are water-soluble salts of the higher alkyl sulfates, such as sodium lauryl sulfate or other suitable alkyl sulfates having 8 to 18 carbon atoms in the alkyl group, water-soluble salts of higher fatty acid monoglyceride monosulfates, such as the sodium salt of the monosulfated monoglyceride of hydrogenated coconut oil fatty acids, alkyl aryl sulfonates such as sodium dodecyl benzene sulfonate, higher alkyl sulfoacetates, higher fatty acid esters of 1,2-dihydroxy propane sulfonate, and the substantially saturated higher aliphatic acyl amides of lower aliphatic amino carboxylic acid compounds, such as those having 12 to 16 carbons in the fatty acid, alkyl or acyl radicals, and the like. Examples of the last mentioned amides are N-lauroyl sarcosinate, and the sodium, potassium, and ethanolamine salts of N-lauroyl, N-myristoyl, or N-palmitoyl sarcosinate sold by W. R. Grace under the tradename "Hamposyl". Also effective are polycarboxylated ethylene oxide condensates of fatty alcohols manufactured by Olin under the tradename of "Polytergent CS-1". It is most preferred that the aqueous cleaning solutions of this invention be low foaming during use. Accordingly, the sulfate and sulfonate surfactants may not always be acceptable if the cleaning process involves agitation of the cleaning solution.

Besides the alkalinity providing agent corrosion inhibitor and optional carboxylated polymer and surfactant as described above, the aqueous metal cleaning compositions of the present invention preferably include a hydrotrope. In use, the dry ingredients of the invention are provided in solution in water which is preferably deionized or purified by reverse osmosis treatment and the like.

The hydrotropes useful in this invention include the sodium, potassium, ammonium and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols and sodium, potassium and ammonium salts of the alkyl sarcosinates. The hydrotropes are useful in maintaining the organic materials including the surfactant readily dispersed in the aqueous cleaning solution and, in particular, in an aqueous concentrate which is an especially preferred form of packaging the compositions of the invention and allow the user of the compositions to accurately provide the desired amount of cleaning composition into the aqueous wash solution. A particularly preferred hydrotrope is one that does not foam. Among the most useful of such hydrotropes are those which comprise the alkali metal salts of intermediate chain length linear alkyl monocarboxylic fatty acids, i.e., $C_7$–$C_{13}$. Particularly preferred are the alkali metal octanoates and nonanoates such as Monotrope 1250 which is a tradename for a solution of sodium nonanoate.

The metal cleaning compositions of this invention comprise from about 10 to about 60 weight percent, preferably, from about 20 to about 30 weight percent based on the dry components of an alkaline metal salt, about 0.5 to about 10 weight % of a corrosion inhibitor compound, from about 5 to about 45 weight % of a surfactant, 0 to about 10 weight percent, preferably, about 1 to about 5 weight percent of a polycarboxylate and 0 to about 45 weight percent, preferably, about 2–30 weight percent of a hydrotrope. Most preferably, the metal cleaning compositions of the present invention are provided and added to the wash bath as an aqueous concentrate in which the dry components of the composition comprise from about 5–45 weight percent of the concentrate, preferably from about 10–30 weight percent. The dry composition is used in the aqueous wash solution in amounts of about 0.1–10 weight percent, preferably from about 0.2–5 weight percent.

Triazoles and alkali metal borates each are added to the compositions of the present invention in amounts of from about 0.5 to about 1.5 wt. % of the dry weight of the compositions. The weight ratio of triazole to alkali metal borate can range from about 2:1 to about 1:2. Preferably, the weight ratio is about 1:1. Alkali metal borate can be added per se, or as boric acid, plus an alkali hydroxide such as sodium or potassium hydroxide, in a concentration of about 3 to about 7% by weight.

If the alkaline metal salt is the preferred carbonate or bicarbonate salt, such salts are preferably present in amounts of about 15–60 percent by weight of the dry components. Preferably, if a combination of such salts is utilized the amount of bicarbonate salts preferably comprises from about 10–50 weight percent and the carbonate salts preferably from about 10–40 weight percent based on the dry composition.

Magnesium typically is added to dry composition in amounts of about 0.1 to about 5 wt. %, preferably from about 0.2 to about 1 wt. %. Thus, useful levels of magnesium ion for producing an anticorrosive effect are between about 25 and 1,500 ppm with respect to the aqueous concentrate. It is preferable to use between about 50 and 200 ppm of magnesium in concentrates. It is to be understood that higher levels of magnesium ion can be included in aqueous concentrates, but for the most part, higher levels than that described are not believed to add significantly to the anticorrosive effect. Aqueous concentrates of the present invention comprise from about 60 to about 90 wt. % deionized water; about 5 to about 20 wt. %, preferably about 8 to about 15 wt. % alkaline salts; about 2 to about 15 wt. %, preferably from about 5 to about 10 wt. % of a hydrotrope; and from about 0.05 to about 1 wt. % of a polymeric dispersant. Individually, alkali metal borates and water soluble triazole compounds each are present in aquoeus concentrates from about 0.2 to about 0.3 wt. %, preferably from about 0.25 to about 0.275 wt. %. Magnesium salts are employed in amounts of from about 0.05 to about 1.0 wt. % of the concentrates.

Aqueous metal cleaning compositions of the present invention are useful in removing a variety of contaminants from metal substrates as previously described. A useful method of cleaning such metal parts is in a parts washer. In parts washers metal parts are contacted with aqueous compositions either by immersion or some type of impingement in which the aqueous cleaning composition is circulated or continuously agitated against the metal part or is sprayed thereon. Alternatively, agitation can be provided as ultrasonic waves. The cleaning composition then is filtered and recycled for reuse in the parts washer.

For best use, aqueous cleaning compositions of this invention are preferably at an elevated temperature typically ranging from about 90°–180° F. Contact time of the aqueous cleaning composition with metal substrates will vary depending upon the degree of contamination but broadly will range between about 1 minute to about 30 minutes with about 3 minutes to about 15 minutes being more typical.

The following examples are intended to illustrate the present invention and not intended to limit the scope of the present invention.

AQUEOUS METAL CLEANER EXAMPLES I AND II AND CONTROLS I and II

The following examples show the effectiveness of an aqueous cleaning solution at a mild pH with a triazole compound and an alkali metal borate corrosion inhibitor in preventing corrosion and discoloration of iron-containing surfaces when exposed to alkaline solutions.

Steel test coupon types A and B; each 5"×5" in size, are immersed for 48 and 72 hours, respectively, in aqueous solutions of the present invention (Examples I and II) and two control solutions each held at 160° F. The coupons are recovered from the test solutions thoroughly rinsed in distilled water and allowed to dry. The coupons then are examined for signs of corrosion.

The test products as aqueous solutions and results of testing for each of the examples and controls are shown in Tables 1 and 2 (solutions) and Table 3 (results).

Referring to Table 3, the results show that the Example formulation of the present invention containing Cobratec and borax in combination are not corrosive to steel in contrast to the control formulations which do not contain cobratec and borax in combination. Both Controls A and B show brown deposits, i.e., rust, over 48 and 72 hours, respectively. The use of cobratec and borax prevent discoloration of steel in addition to providing an anticorrosive effect at mild pH levels.

TABLE 1

| | Alkali Metal Cleaner Example (% Weight) | |
|---|---|---|
| | I | II |
| Water | 78.33 | 78.40 |
| Sodium bicarbonate | 4.48 | 4.48 |
| Sodium carbonate | 2.22 | 2.22 |
| Potassium carbonate | 2.90 | 2.90 |
| Cobratec[1] | 0.25 | 0.25 |
| Borax[2] | 0.25 | 0.25 |
| Magnesium oxide | 0.074 | 0.00 |
| Alcosperse 2310[3] | 0.50 | 0.50 |
| Monatrope 1250 | 6.50 | 6.50 |
| Alcodet 260[4] | 3.00 | 3.00 |
| ISP LP-100[5] | 1.50 | 1.50 |

[1]1,2,3-benzotriazole
[2]Sodium tetraborate pentahydrate
[3]Acrylic acid polymer, MW 2,500–4,500, Alco Chemical Corp., Chattanooga, TN
[4]Ethoxylated dodecyl mercaptan (6 ethylene oxide units), Rhone-Poulenc.
[5]N-alkyl pyrrolidone, ISP

TABLE 2

| | Controls (% Weight) | |
|---|---|---|
| | I | II |
| Water | 73.84 | 79.72 |
| Sodium hydroxide | 0.00 | 0.40 |
| Cobratec | 0.00 | 0.25 |
| Pot. bicarbonate | 10.00 | 0.00 |
| Borax | 0.25 | 0.00 |
| Potassium carbonate | 1.96 | 7.81 |
| Monotrope 1250 | 6.50 | 6.50 |
| Magnesium oxide | 0.074 | 0.00 |
| Alco 2310 | 1.75 | 1.75 |
| Alcodet 260 | 3.75 | 0.00 |
| ISP LP-100 | 1.88 | 2.00 |
| Olin SL-92 | 0.00 | 1.50 |
| Potassium silicate | 0.00 | 1.00 |

TABLE 3

| | | Visual appearance Steel Type | |
|---|---|---|---|
| | pH | A | B |
| Example I | 9.0 | No discoloration | No discoloration |
| Example II | 8.5 | No discoloration | No discoloration |
| Control I | 8.5 | brown | brown |
| Control II | 11.0 | brown | brown |

AQUEOUS METAL CLEANER EXAMPLES III AND IV AND CONTROLS III AND IV

The following examples show the effectiveness of an aqueous cleaning solution at a mild pH with a triazole compound and an alkali metal borate corrosion inhibitor in preventing corroisn and discoloration of brass surfaces when exposed to alkaline solutions.

Brass test coupon types C and D; each 5"×5" in size, are immersed for 24 and 96 hours, respectively, in aqueous solutions of the present invention (Examples III and IV) and two control solutions each held at 140° F. The coupons are recovered from the test solutions then are examined for signs of corrosion.

The test products as aqueous solutions and results of testing for each of the examples and controls are shown in Tables 4 and 5 (solutions) and Table 6 (results).

Referring to Table 6, the results show that the Example formulations of the present invention containing Cobratec and borax in combination are not corrosive to brass over 24 hours and over 96 hours. In contrast, Control Coupon D shows spotty deposits, i.e., corrosion over 96 hours. The use of cobratec and borax prevent discoloration of brass in addition to providing an anticorrosive effect at mild pH levels for longer time periods than the control formulations not having the Cobratec and borax combination.

TABLE 4

| | Alkali Metal Cleaner Example (% Weight) | |
|---|---|---|
| | III | IV |
| Water | 78.33 | 78.40 |
| Sodium bicarbonate | 4.48 | 4.48 |
| Sodium carbonate | 2.22 | 2.22 |
| Potassium carbonate | 2.90 | 2.90 |
| Cobratec[1] | 0.25 | 0.25 |
| Borax[2] | 0.25 | 0.25 |
| Magnesium oxide | 0.074 | 0.00 |
| Alcosperse 2310[3] | 0.50 | 0.50 |
| Monatrope 1250 | 6.50 | 6.50 |
| Alcodet 260[4] | 3.00 | 3.00 |
| ISP LP-100[5] | 1.50 | 1.50 |

[1]1,2,3-benzotriazole
[2]Sodium tetraborate pentahydrate
[3]Acrylic acid polymer, MW 2,500–4,500, Alco Chemical Corp., Chattanooga, TN
[4]Ethoxylated dodecyl mercaptan (6 ethylene oxide units), Rhone-Poulenc.
[5]N-alkyl pyrrolidone, ISP

TABLE 5

| | Controls (% Weight) | |
|---|---|---|
| | III | IV |
| Water | 73.84 | 79.72 |
| Sodium hydroxide | 0.00 | 0.40 |
| Cobratec | 0.00 | 0.25 |
| Pot. bicarbonate | 10.00 | 0.00 |
| Borax | 0.25 | 0.00 |
| Potassium carbonate | 1.96 | 7.81 |
| Monotrope 1250 | 6.50 | 6.50 |
| Magnesium oxide | 0.074 | 0.00 |
| Alco 2310 | 1.75 | 1.75 |
| Alcodet 260 | 3.75 | 0.00 |
| ISP LP-100 | 1.88 | 2.00 |
| Olin SL-92 | 0.00 | 1.50 |
| Potassium silicate | 0.00 | 1.00 |

TABLE 6

| | | Visual appearance brass Type | |
|---|---|---|---|
| | | C | D |
| Example III | 9.6 | No discoloration | No discoloration |
| Example IV | 8.5 | No discoloration | No discoloration |
| Control III | 8.5 | No discoloration | spotty |
| Control IV | 9.6 | No discoloration | spotty |

What is claimed is:

1. A metal cleaner-anticorrosion composition comprising an alkaline metal salt, whereby the alkaline metal salt is not a borate, a surfactant, and an anticorrosion agent comprising a triazole compound in combination with an alkali metal borate, wherein a pH of the composition in aqueous solution is from 7.5 to less than 10.

2. The composition of claim 1, wherein the alkaline metal salt comprises a carbonate salt, a bicarbonate salt or mixtures thereof.

3. The composition of claim 1, wherein the alkali metal borate and the triazole compound each comprise from about 0.5 to about 1.5 wt. % of the composition.

4. The composition of claim 1, wherein a weight ratio of triazole compound to alkali metal borate is about 1:1.

5. The composition of claim 1, wherein the triazole compound is a water soluble 1,2,3-triazole compound.

6. The composition of claim 5, wherein the 1,2,3-triazole compound comprises 1,2,3-benzotriazole; 4-phenyl-1,2,3-triazole; 1,2-naphthotriazole; 4-nitrobenzotriazole; 1,2,3-tolytriazole; 4-methyl-1,2,3-triazole; 4-ethyl-1,2,3-triazole; 5-methyl-1,2,3-triazole; 5-ethyl-1,2,3-triazole; 5-propyl-1,2,3-triazole or 5-butyl-1,2,3-triazole.

7. The composition of claim 1, wherein the alkali metal borate comprises sodium tetraborate pentahydrate or sodium tetraborate decahydrate.

8. The composition of claim 1, wherein the surfactant is a nonionic surfactant.

9. The composition of claim 1, wherein the surfactant comprises an ethoxylated alkyl-thiol having from 7 to 20 carbon atoms and is ethoxylated with 3 to 15 ethylene oxide units.

10. The composition of claim 9, further including a nitrogen-containing surfactant.

11. The composition of claim 10, wherein the nitrogen-containing surfactant is an N-alkyl pyrrolidone.

12. The composition of claim 1, further comprising a hydrotrope.

13. The composition of claim 1, further comprising a water soluble salt of magnesium and a carboxylated polymer.

14. The composition of claim 1, wherein the composition is free of silicate.

15. An aqueous metal cleaning concentrate comprising a cleaning-anticorrosion composition wherein the composition comprises from about 5 to about 45 wt. % of the concentrate with the balance water, wherein the composition comprises an alkaline metal salt, whereby the alkaline metal salt is not a borate, a surfactant, and an anticorrosion agent comprising a triazole compound in combination with an alkali metal borate, wherein a pH of the concentrate ranges from about 7.5 to less than 10.

16. The aqueous concentrate of claim 15, wherein the alkaline metal salts comprise carbonate salts, bicarbonate salts or mixtures thereof.

17. The aqueous concentrate of claim 15, wherein the metal cleaning composition comprises from about 10 to about 60 wt. % of the alkaline metal salt, from about 5 wt. % to about 45 wt. % of the surfactant, from about 0.5 wt. % to about 1.5 wt. % of each of the triazole compound and the alkali metal borate and from 0 to about 45 wt. % of a hydrotrope.

18. The aqueous concentrate of claim 15, wherein the metal cleaning composition is free of silicates.

19. The aqueous concentrate of claim 15, wherein the triazole compound comprises a water soluble 1,2,3-triazole compound.

20. The aqueous concentrate of claim 19, wherein the water soluble 1,2,3-triazole compound comprises 1,2,3-benzotriazole; 4-phenyl-1,2,3-triazole; 1,2-naphthotriazole; 4-nitrobenzotriazole; 1,2,3-tolytriazole; 4-methyl-1,2,3-triazole; 4-ethyl-1,2,3-triazole; 5-methyl-1,2,3-triazole; 5-ethyl-1,2,3-triazole; 5-propyl-1,2,3-triazole; or 5-butyl-1,2,3-triazole.

21. The aqueous concentrate of claim 15, wherein the alkali metal borate comprises sodium tetraborate pentahydrate or sodium tetraborate decahydrate.

22. The aqueous concentrate of claim 15, wherein the surfactant is a nonionic surfactant.

23. The aqueous concentrate of claim 15, wherein the surfactant is an ethoxylated alkyl-thiol having from 7 to 20 carbons and is ethoxylated with 3 to 15 ethylene oxide units.

24. The aqueous concentrate of claim 23, further comprising a nitrogen-containing surfactant.

25. The aqueous concentrate of claim 24, wherein the nitrogen-containing surfactant is an N-alkyl pyrrolidone.

26. The aqueous concentrate of claim 15, wherein a weight ratio of the triazole compound to the alkali metal borate is about 1:1.

27. An aqueous metal cleaning-anticorrosion solution comprising a metal cleaning-anticorrosion composition wherein the composition comprises from about 1 to about 10 wt. % of the aqueous solution with the balance water, wherein the composition comprises an alkaline metal salt, whereby the alkaline metal salt is not a borate, a surfactant, and an anticorrosion agent comprising a triazole compound in combination with an alkali metal borate, wherein a pH of the solution ranges from about 7.5 to less than 10.

28. The aqueous solution of claim 27, wherein a weight ratio of triazole compound to alkali metal borate is about 1:1.

29. The aqueous solution of claim 27, wherein the triazole compound comprises a water soluble 1,2,3-triazole.

30. The aqueous solution of claim 29, wherein the 1,2,3-triazole comprises 1,2,3-benzotriazole; 4-phenyl-1,2,3-triazole; 1,2-naphthotriazole; 4-nitrobenzotriazole; 1,2,3-tolytriazole; 4-methyl-1,2,3-triazole; 4-ethyl-1,2,3-triazole; 5-methyl-1,2,3-triazole; 5-ethyl-1,2,3-triazole; 5-propyl-1,2,3-triazole; or 5-butyl-1,2,3-triazole.

31. The aqueous solution of claim 27, wherein the alkali metal borate comprises sodium tetraborate pentahydrate or sodium tetraborate decahydrate.

32. The aqueous solution of claim 27, wherein the metal cleaning composition is free of silicates.

33. The aqueous solution of claim 27, wherein the surfactant is a nonionic surfactant.

34. The aqueous solution of claim 27, wherein the surfactant is an ethoxylated alkyl-thiol having from 7 to 20 carbons and is ethoxylated with 3 to 15 ethylene oxide units.

35. The aqueous solution of claim 34, further comprising a nitrogen-containing surfactant.

36. The aqueous solution of claim 35, wherein the nitrogen-containing surfactant is an N-alkyl pyrrolidone.

37. The aqueous solution of claim 27, wherein the alkaline metal salts comprise carbonate salts, bicarbonate salts or mixtures thereof.

38. A method for cleaning and for preventing corrosion of metal comprising contacting a surface of a metal substrate with an aqueous solution for a sufficient amount of time to remove contaminants therefrom and to prevent corrosion, the aqueous solution containing a composition comprising an alkaline metal salt, whereby the alkaline metal salt is not a borate, a surfactant, and an anticorrosion inhibitor comprising a triazole compound in combination with an alkali metal borate, wherein a pH of the solution ranges from about 7.5 to less than 10.

39. The method of claim 38, wherein the alkaline metal salt comprises from about 10 to about 60 wt. % of the composition, the triazole compound and the alkali metal borate each comprise from about 0.5 to about 1.5 wt. % of the composition, the surfactant comprises from about 5 to about 45 wt. % of the composition, and a hydrotrope comprising from 0 to about 45 wt. % of the composition.

40. The method of claim 38, wherein the alkaline metal salt comprises a carbonate salt, a bicarbonate salt or mixtures thereof.

41. The method of claim 38, wherein the triazole comprises a water soluble 1,2,3-triazole.

42. The method of claim 41, wherein the water soluble 1,2,3-triazole comprises 1,2,3-benzotriazole; 4-phenyl-1,2,3-triazole; 1,2-naphthotriazole; 4-nitrobenzotriazole; 1,2,3-tolytriazole; 4-methyl-1,2,3-triazole; 4-ethyl-1,2,3-triazole; 5-methyl-1,2,3-triazole; 5-ethyl-1,2,3-triazole; 5-propyl-1,2,3-triazole; or 5-butyl-1,2,3-triazole.

43. The method of claim 38, wherein the alkali metal borate comprises sodium tetraborate pentahydrate or sodium tetraborate decahydrate.

44. The method of claim 38, wherein the surfactant comprises a nonionic surfactant.

45. The method of claim 38, wherein the surfactant is an ethoxylated-thiol having from 7 to 20 carbon atoms and is ethoxylated with 3 to 15 ethylene oxide units.

46. The method of claim 45, wherein the aqueous solution further comprises a nitrogen-containing surfactant.

47. The method of claim 46, wherein the nitrogen-containing surfactant is an N-alkyl pyrrolidone.

48. The method of claim 38, wherein a weight ratio of the triazole compound to the alkali metal borate is about 1:1.

49. The method of claim 38, wherein the metal substrate contains copper.

* * * * *